US009266672B2

(12) United States Patent
Stewart et al.

(10) Patent No.: US 9,266,672 B2
(45) Date of Patent: Feb. 23, 2016

(54) CRADLE FOR A SIDE LOADING ARM FOR REFUSE VEHICLE

(71) Applicant: The Heil Co., Chattanooga, TN (US)

(72) Inventors: Bryan Stewart, Chattanooga, TN (US); David C. Gentry, Chattanooga, TN (US)

(73) Assignee: The Heil Co., Chattanooga, TN (US)

( * ) Notice: Subject to any disclaimer, the term of this patent is extended or adjusted under 35 U.S.C. 154(b) by 277 days.

(21) Appl. No.: 13/793,423

(22) Filed: Mar. 11, 2013

(65) Prior Publication Data

US 2014/0119860 A1 May 1, 2014

Related U.S. Application Data

(60) Provisional application No. 61/720,698, filed on Oct. 31, 2012.

(51) Int. Cl.
*B65F 3/02* (2006.01)
*B65F 3/04* (2006.01)

(52) U.S. Cl.
CPC ..... *B65F 3/04* (2013.01); *B65F 2003/023* (2013.01)

(58) Field of Classification Search
CPC ..... B65F 2003/025; B65F 3/041
USPC ..... 198/312, 313, 632
See application file for complete search history.

(56) References Cited

U.S. PATENT DOCUMENTS

| | | | | |
|---|---|---|---|---|
| 3,006,492 | A | 10/1961 | Haughton | |
| 3,148,794 | A | 9/1964 | Sauer | |
| 4,239,441 | A | 12/1980 | Maynard | |
| 4,239,442 | A | 12/1980 | Maynard | |
| 4,461,607 | A * | 7/1984 | Smith | 414/406 |
| 4,978,243 | A | 12/1990 | Hensler | |
| 4,983,092 | A | 1/1991 | Richards | |
| 5,402,898 | A | 4/1995 | Lute | |
| 5,577,877 | A | 11/1996 | Smith et al. | |
| 5,607,277 | A * | 3/1997 | Zopf | 414/408 |
| 5,609,261 | A | 3/1997 | Hensler | |
| 5,755,547 | A | 5/1998 | Flerchinger et al. | |
| 5,850,891 | A * | 12/1998 | Olms et al. | 182/127 |
| 5,988,970 | A | 11/1999 | Holtom | |
| 6,000,593 | A * | 12/1999 | Chimenti | 224/504 |
| 6,004,092 | A | 12/1999 | Johnson et al. | |
| 6,077,020 | A * | 6/2000 | Neufeldt et al. | 414/399 |
| 6,494,665 | B1 * | 12/2002 | Bingman | 414/409 |
| 6,644,906 | B2 | 11/2003 | Bayne | |
| 6,846,148 | B2 | 1/2005 | Riba Romeva et al. | |
| 6,921,239 | B2 | 7/2005 | Arrez et al. | |
| 7,210,890 | B2 * | 5/2007 | Curotto et al. | 414/408 |
| 7,347,657 | B2 | 3/2008 | Brunn | |
| 7,390,159 | B2 | 6/2008 | Rimsa et al. | |
| 7,871,233 | B2 * | 1/2011 | Arrez et al. | 414/408 |
| 8,092,141 | B2 | 1/2012 | Curotto et al. | |
| 2003/0111501 | A1 | 6/2003 | McGraw et al. | |
| 2010/0179912 | A1 | 7/2010 | Curotto | |
| 2010/0183410 | A1 | 7/2010 | Curotto | |
| 2010/0206642 | A1 | 8/2010 | Curotto | |
| 2010/0281654 | A1 | 11/2010 | Curotto | |
| 2011/0266296 | A1 | 11/2011 | Curotto | |
| 2012/0087773 | A1 * | 4/2012 | Curotto et al. | 414/810 |

* cited by examiner

*Primary Examiner* — Saul Rodriguez
*Assistant Examiner* — Mark Hageman
(74) *Attorney, Agent, or Firm* — Harness, Dickey & Pierce, P.L.C.

(57) ABSTRACT

A support rack for a side loading arm of a refuse vehicle has a frame to secure with the refuse vehicle. A rack is pivotally coupled with the frame. A biasing member is coupled between the rack and frame. The biasing member enables pivotal movement of the rack between a first and second position. The biasing member returns the rack to the first position after movement into the second position.

14 Claims, 5 Drawing Sheets

CRADLE FOR A SIDE LOADING ARM FOR REFUSE VEHICLE

CROSS-REFERENCE TO RELATED APPLICATION

This application claims the benefit of U.S. Provisional Application No. 61/720,698, filed on Oct. 31, 2012. The entire disclosure of the above application is incorporated herein by reference.

FIELD

The present disclosure relates to refuse vehicles and, more particularly, to a cradle that support a side loading arm during over road transportation.

BACKGROUND

Cradles or storage racks exist for carrying side loading arms of refuse vehicles during over the road travel conditions. Ordinarily, the storage racks include an arm, via an interference fit, that connects the rack and arm together. However, over time, as the side loading arm is run multiple times and hits the rack during operation, the rack deforms. Once the rack is deformed, it no longer serves its purpose to support the arm during over road travel conditions. Thus, it is desirable in the art to have a support rack or cradle that is able to support the side loading arm during over road travel conditions for a long period of time.

The present disclosure provides the art with such a cradle or storage rack design. The present disclosure provides a biased rack that provides for movement of the side loading arm during over road traveling. The rack is biased such that the rack moves during bumpy conditions or the like, when excessive forces are applied to the arm, to enable movement of the arm. The rack is spring loaded to hold the arm in a rest position and to bias during an exerted force on the rack and to return the side loading arm to its original position after the force has been removed.

SUMMARY

According to an aspect of the disclosure, a support rack for a side loading arm of a refuse vehicle comprises a frame to secure with the refuse vehicle. A rack is pivotally coupled with the frame. A biasing member is coupled between the rack and frame. The biasing member enables pivotal movement of the rack between a first and second position. The biasing member returns the rack to the first position after movement into the second position. The biasing member includes a pin passing through the rack and frame and a spring connected between the pin and the rack. A shelf is coupled with the rack to receive the side loading arm.

According to another aspect of the disclosure, a refuse vehicle, including a side loading arm, has a support rack coupled with a frame of the vehicle. The support rack comprises a frame secured to the refuse vehicle. A rack is pivotally coupled with the frame. A biasing member is coupled between the rack and frame. The biasing member enables pivotal movement of the rack between a first and second position. The biasing member returns the rack to the first position after movement into the second position. The biasing member includes a pin passing through the rack and frame and a spring connected between the pin and the rack. A shelf is coupled with the rack to receive the side loading arm.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
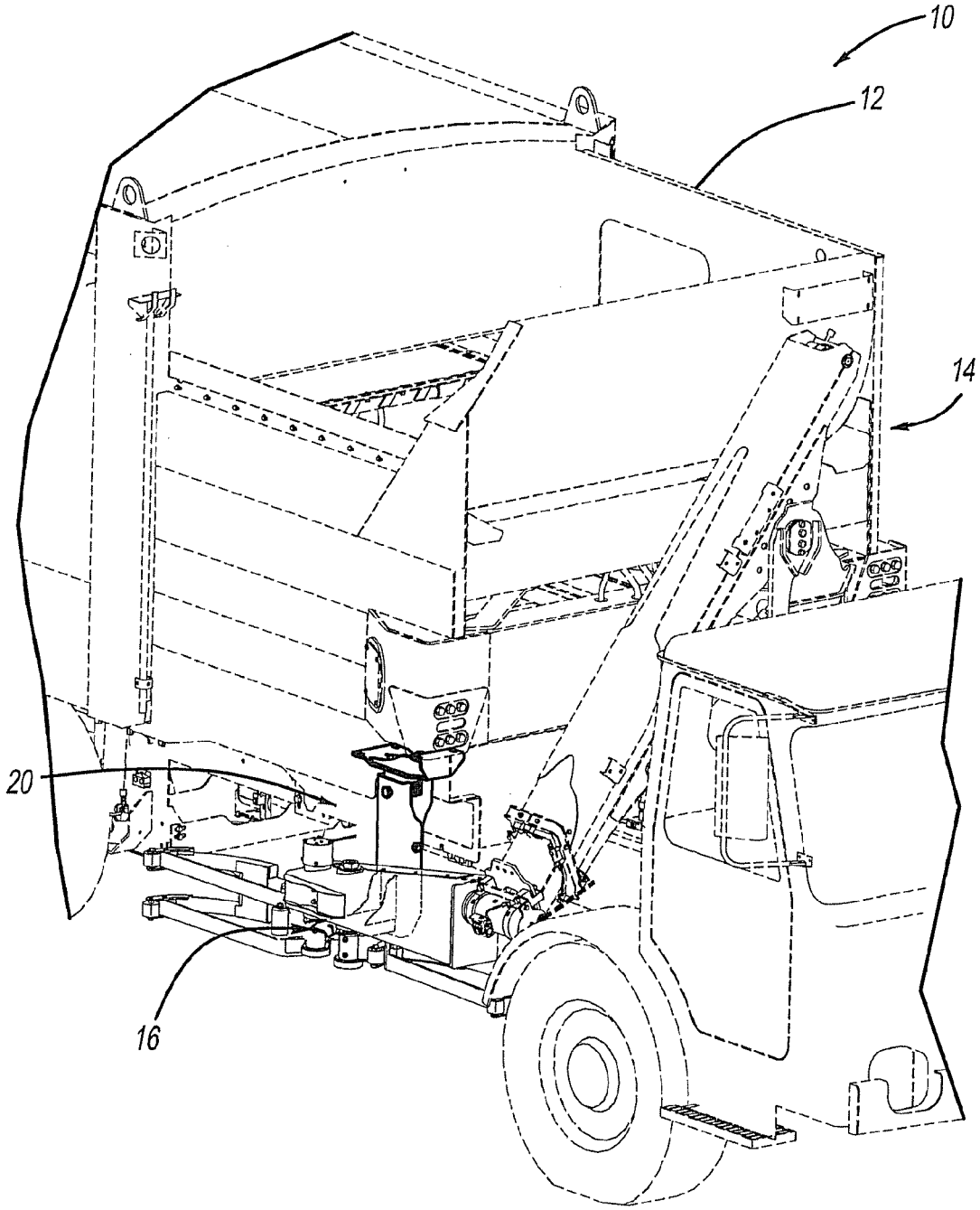
FIG. 1 is a perspective view of a storage rack coupled with a refuse vehicle.
Figure 2:
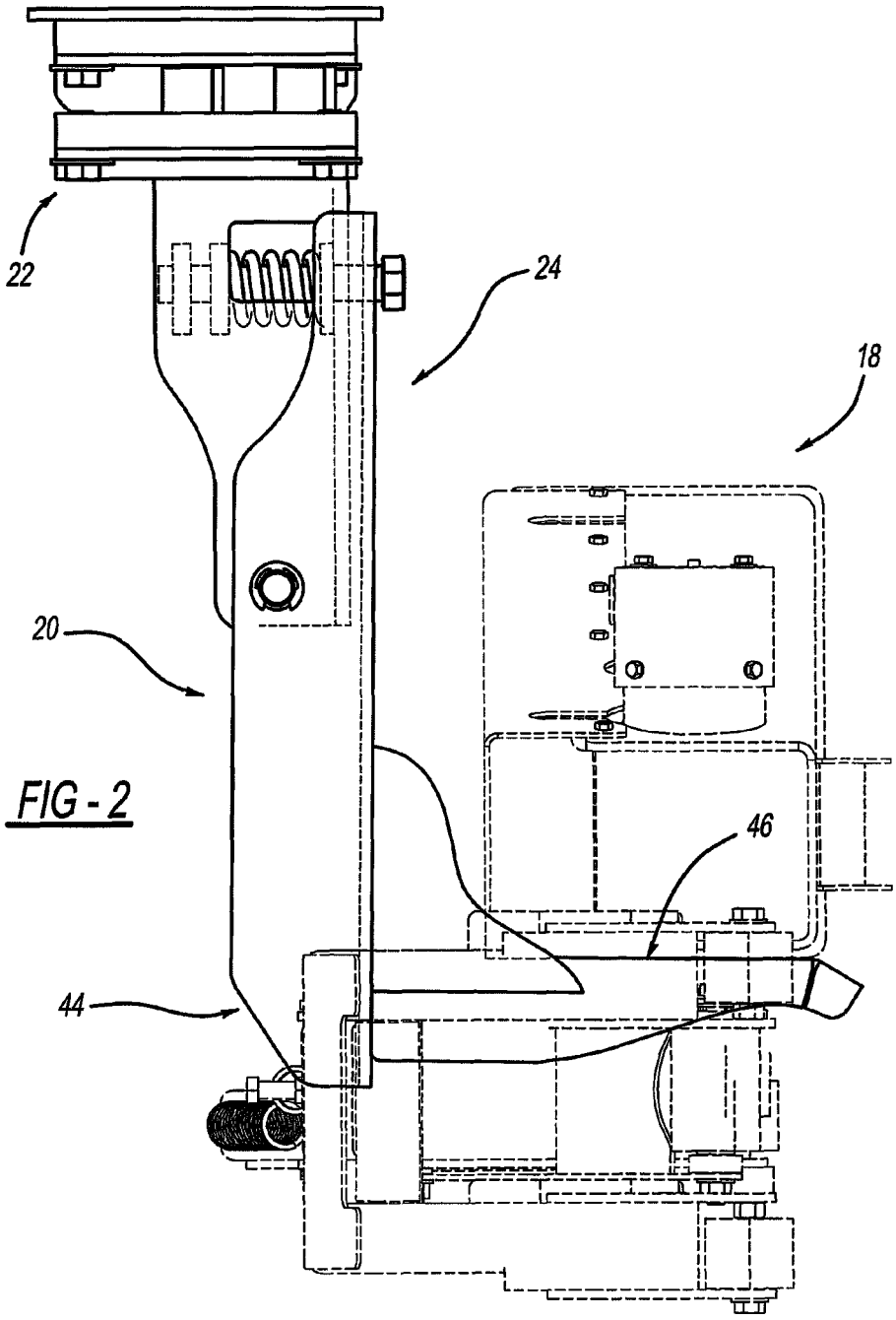
FIG. 2 is a side elevation view of FIG. 1.

Turning to the figures, FIG. 1 illustrates a refuse vehicle designated with the reference numeral 10. The refuse vehicle 10 includes a waste collection container 12 and a truck cab illustrated in phantom. Also, a side loading arm 14 is illustrated secured with the collection container 12. The side loading arm 14 includes a grabber 16 that is positioned on a storage rack 20. The storage rack 20 is coupled with a frame member of the vehicle or the collection container 12.

Figure 3:
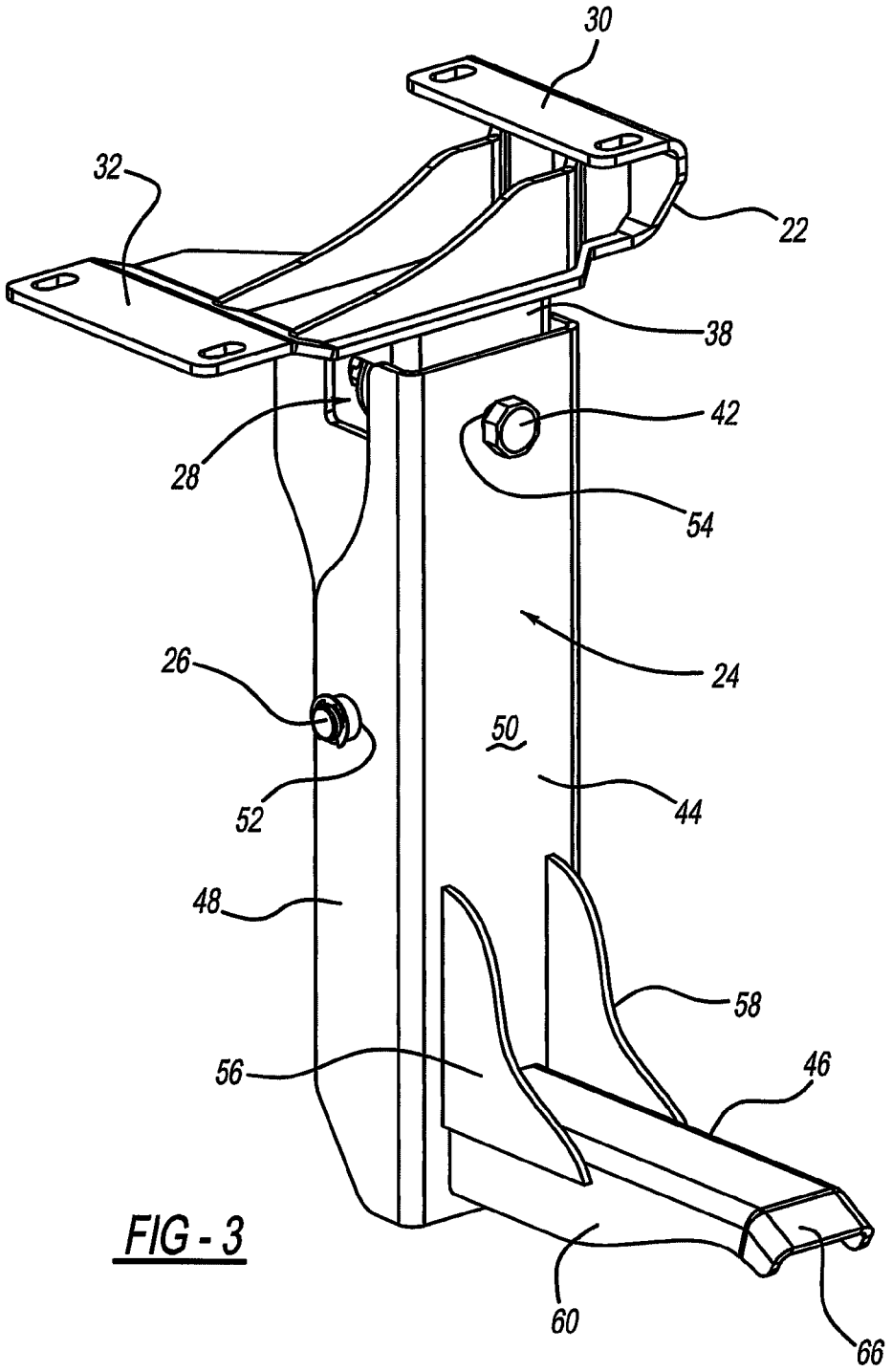
FIG. 3 is a perspective view of the storage rack.
Figure 4:
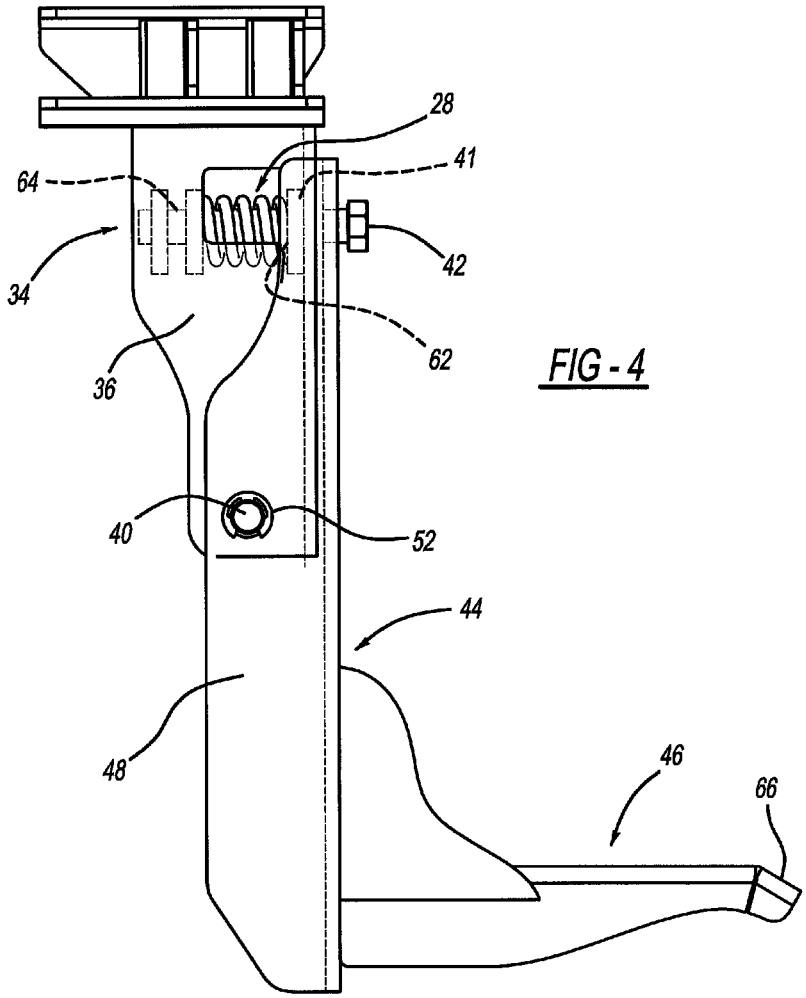
FIG. 4 is a side elevation view of the rack of FIG. 3 in a first position.
Figure 5:
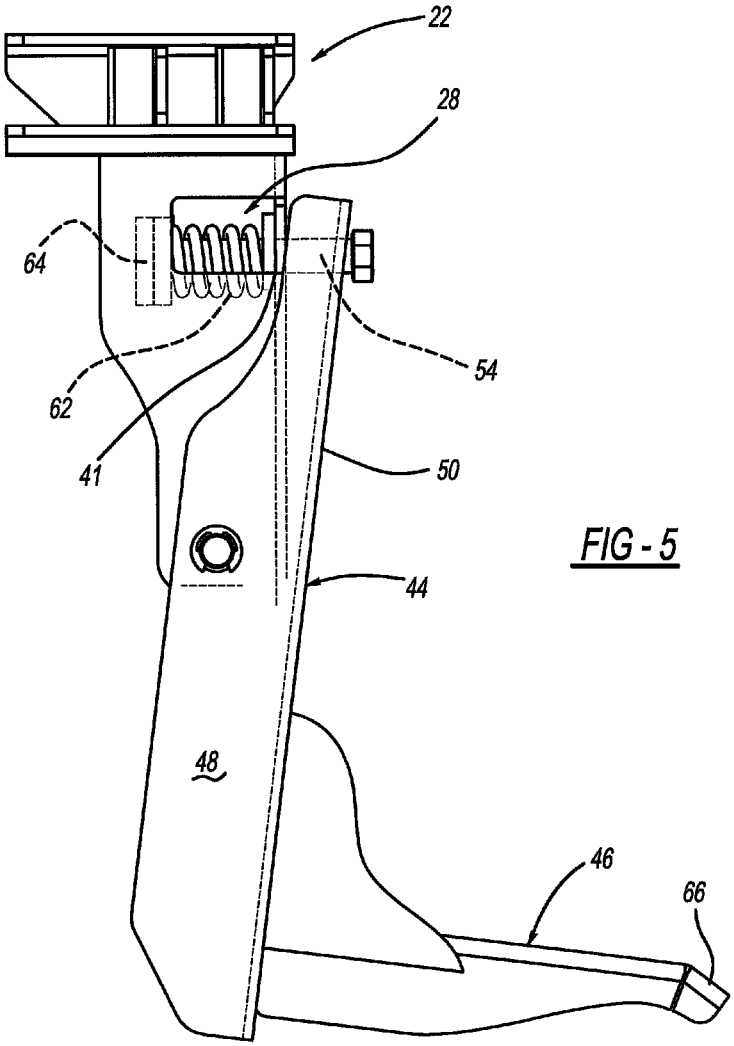
FIG. 5 is a side elevation view of the rack of FIG. 3 in a second position.

Turning to FIGS. 3-5, a better understanding of the storage rack will be had. The storage rack 20 includes a frame 22 and a rack 24. The rack 24 is pivotally coupled with the frame 22 by a pivot pin 26. Also, the rack 24 is coupled with the frame 22 via a biasing member 28.

The frame 22 includes a pair of attached members 30 and 32. The attachment members 30, 32 enable the frame to be coupled with a frame member or the like of the vehicle 10. The frame 22 includes a coupling portion 34. The coupling portion 34 is welded or the like with the frame 22. The coupling portion 34 has an overall U-shape with a pair of sidewalls 36 and a web 38 connecting the sidewalls 36 with one another. The sidewalls 36 include an aperture 40 to receive the pivot pin 26. The web 38 includes an aperture 41 that receives a pin 42 of the biasing member 28.

The rack 24 has an overall L-shape with a vertical portion 44 and a horizontal portion 46 which acts as a shelf. The vertical portion 44 has an overall U-shape with a pair of sidewalls 48 and a web 50. The sidewalls 48 include apertures 52 to receive the pivot pin 26. Additionally, the web 50 includes an aperture 54 that receives the pin 42 of the biasing member 28.

The horizontal portion 46 is welded or the like to the vertical portion 44. The horizontal portion 46 extends a desired distance from the vertical portion 44 to enable the grabber 16 to rest on the horizontal portion 46. The horizontal portion 46 may have an overall U-shape to provide reinforcement strength to the horizontal portion 46. An end 66 angles downward from the horizontal portion 46. The end 66 enhances movement of the grabber 16 onto and off of the horizontal portion 46. Additionally, plates 56, 58 can be positioned on the sidewalls 60 of the horizontal portion 46 and welded or the like to connect with the vertical portion 44 to provide additional strength.

The biasing member 28 includes pin 42 as well as a helical spring 62. The pin 42 may be a threaded bolt and include a nut or the like 64 that secures the helical spring 62 between the nut 64 and the web 38 of the frame coupling portion 34.

In operation, the grabber assembly 18 is positioned on the rack 24 resting on the horizontal portion 46. In a home, rest or first position, the spring 62 is in an uncompressed state. Thus, the horizontal portion 46 is substantially horizontal with respect to the ground. As the vehicle is driven over the road, travel condition exists. The biasing member 28 enables the rack 24 to pivot about the pivot pin 26 as forces are applied to the storage rack via the side loading arm 14. Thus, the rack 24 articulates with respect to the base 22 enabling the rack 20 to absorb the force exerted by the side loading arm 14 during over road travel conditions. After the rack has moved to a second position, as illustrated in FIG. 5, once the force is removed, the biasing member 28, via the spring 62, returns the rack 24 to its first or home position as illustrated in FIG. 4.

Further, when the side loading arm 14 is in its home position, approximately 400 to 600 lbf is supported by the rack 24 depending upon the compressed length of the spring. Thus, if the 400 lbf is suppressed, the shock of the rack from over the road travel is minimized due to the damping effect of the spring.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A support rack for a side loading arm of a refuse vehicle comprising:

a frame for securing with the refuse vehicle, the frame including a rack receiving portion;

a rack having a first portion and a second portion, the first portion received on the frame rack receiving portion, the first portion pivotally coupled with the frame such that in a first position, the longitudinal axis of the first portion is substantially vertical and, the second portion receiving the side loading arm extends from a lower area of the first portion to provide a substantially horizontal load receiving area; and a biasing member coupled between the rack first portion and frame rack receiving portion, the biasing member enabling pivotal movement of the rack first portion between the first and a second position wherein the biasing member returns the rack to the first position after movement into the second position.

2. The support rack of claim 1, wherein the biasing member includes a pin passing through the rack first portion and frame rack receiving portion and a spring connected between the pin and the rack first portion.

3. The support rack of claim 1, further comprising a shelf coupled with the rack second portion for receiving the arm.

4. The support rack of claim 1, wherein the rack has overall L-shape.

5. The support rack of claim 1, wherein the rack includes a web and a pair of legs extending from the web to provide the overlaying on the frame rack receiving portion.

6. The support rack of claim 1, wherein the frame rack receiving portion has an overall U-shape in cross section.

7. The support rack of claim 1, wherein the rack second portion includes an end portion, the end portion enhances loading and removal of the side loading arm.

8. A refuse vehicle comprising:

a refuse container and a vehicle cab;

a side loading arm connected with the collection container;

a frame coupled with the refuse vehicle, the frame including a portion for receiving a storage rack;

a storage rack receiving the side loading arm, the storage rack coupled with the frame rack receiving portion on the refuse collection container vehicle, the storage rack comprising:

a rack pivotally coupled with the frame rack receiving portion; and a biasing member coupled between the rack and frame rack receiving portion, the biasing member enabling pivotal movement of the rack on the frame rack receiving portion between a first and second position wherein the biasing member returns the rack to the first position after movement into the second position, wherein the storage rack in the first position is configured such that the longitudinal axis of the first portion is substantially vertical and the second portion extends from a lower area of the first portion to provide a substantially horizontal load receiving area.

9. The refuse vehicle of claim 8, wherein the biasing member includes a pin passing through the rack and frame and a spring connected between the pin and the rack.

10. The refuse vehicle of claim 8, further comprising a shelf coupled with the rack for receiving the arm.

11. The refuse vehicle of claim 8, wherein the rack has overall L-shape.

12. The refuse vehicle of claim 8, wherein the rack includes a web and a pair of legs extending from the web.

13. The refuse vehicle of claim 8, wherein the frame has an overall U-shape in cross section.

14. The refuse vehicle of claim 8, wherein the rack includes an end portion, to enhance the end portion enhances loading and removal of the side loading arm.

* * * * *

UNITED STATES PATENT AND TRADEMARK OFFICE

CERTIFICATE OF CORRECTION

PATENT NO. : 9,266,672 B2
APPLICATION NO. : 13/793423
DATED : February 23, 2016
INVENTOR(S) : Bryan Stewart et al.

It is certified that error appears in the above-identified patent and that said Letters Patent is hereby corrected as shown below:

In the claims

Column 4

| | |
|---|---|
| Line 24, claim 8 | after “collection”, delete “container” |
| Line 51, claim 14 | before “the”, delete “to enhance” |

Signed and Sealed this
Thirty-first Day of May, 2016

Michelle K. Lee

Michelle K. Lee
*Director of the United States Patent and Trademark Office*